US012527383B2

(12) United States Patent
Wiley

(10) Patent No.: US 12,527,383 B2
(45) Date of Patent: Jan. 20, 2026

(54) EMERGENCY CASH SYSTEM

(71) Applicant: Wisconsin Alumni Research Foundation, Madison, WI (US)

(72) Inventor: John Duncan Wiley, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 18/509,554

(22) Filed: Nov. 15, 2023

(65) Prior Publication Data

US 2025/0151862 A1 May 15, 2025

(51) Int. Cl.
*A45C 1/12* (2006.01)

(52) U.S. Cl.
CPC ..... *A45C 1/12* (2013.01)

(58) Field of Classification Search
CPC ..... A45C 1/12; A45C 11/18; A45C 11/182; G07D 9/002; G07D 9/004; G07D 2211/00; E04C 1/42; C03B 23/24
See application file for complete search history.

(56) References Cited

U.S. PATENT DOCUMENTS 596,278 A * 12/1897 Perkins ..... B63C 7/30 441/32
1,721,388 A * 7/1929 Glass ..... A45C 1/12 232/6
2,330,363 A * 9/1943 Kaziska ..... E04C 1/42 65/58
2,808,199 A * 10/1957 Rappeport ..... G07D 9/004 232/5
3,312,336 A * 4/1967 Fally ..... G07D 9/004 206/0.82
3,847,277 A * 11/1974 Doner ..... A45C 1/12 D11/147
4,126,267 A * 11/1978 Emmie ..... A45C 1/12 232/4 R
4,153,197 A * 5/1979 Hall ..... G07D 9/002 232/5
4,602,712 A * 7/1986 Williams ..... A45C 11/182 206/1.5
8,789,745 B1 * 7/2014 Barbary ..... A45C 1/12 446/8
10,542,800 B2 * 1/2020 Gross ..... G07F 1/06
2012/0067746 A1 * 3/2012 Gremaud ..... G07D 9/002 206/0.81
2015/0164192 A1 * 6/2015 Gross ..... G06Q 20/3829 232/4 R
2015/0320163 A1 * 11/2015 Gordon ..... A45C 1/12 232/4 R

FOREIGN PATENT DOCUMENTS

CA 2290871 A1 * 5/2001 ..... B65D 23/00

* cited by examiner

*Primary Examiner* — William L Miller
(74) *Attorney, Agent, or Firm* — Boyle Fredrickson S.C.

(57) ABSTRACT

An emergency cash container is constructed of a frangible glass to protect and allow ready access to contained cash while presenting a physical and psychological barrier to opening the container consistent with preserving the cash for emergency use.

14 Claims, 3 Drawing Sheets

EMERGENCY CASH SYSTEM

STATEMENT REGARDING FEDERALLY SPONSORED RESEARCH OR DEVELOPMENT

NA

CROSS REFERENCE TO RELATED APPLICATION

NA

BACKGROUND OF THE INVENTION

The present invention relates to currency storage containers and in particular to a currency storage container for emergency cash.

It can be important to have money available in an emergency, where an inability to pay for goods or service can expose an individual to significant risks to life health or property. In such situations, alternative payment methods, such as credit cards or electronic devices like phones, may not be accepted and, for this reason, a source of emergency cash may be preferred.

Individuals often address this problem by partitioning a small amount of cash in their wallet, purse, or vehicle, separate from cash used for routine transactions, and yet readily accessible in an emergency. These conditions of being both separated and readily accessible are inherently in tension and may result in an individual using the emergency cash in non-emergency situations, when convenience suggests this use, leaving the emergency cash depleted in a genuine emergency.

What is needed is a method of storing emergency cash that is both readily accessible and yet resists use in non-emergency situations.

SUMMARY OF THE INVENTION

The present invention addresses the problems of storing cash so that it is both immediately accessible and yet resistant to casual use, by providing a denomination of cash sealed in a glass tube. The resulting container can be readily carried, for example, in a purse, for ready accessibility, and yet resists casual use both by means of the physical barrier presented by the glass tube and the psychological barrier rising from our natural reluctance to irreversibly break a glass object. In this way, the invention provides a balancing between availability and resistance to nonemergency use of emergency cash.

More specifically, in one embodiment, the invention provides an emergency cash container having a tube with a glass outer wall and closed at opposite ends to define a sealed volume. Paper currency having a value of greater than $20 in 2023 may be positioned within the sealed volume so as to be removable from the sealed volume only by breaking the tube.

It is thus a feature of at least one embodiment of the invention to provide a useful amount of emergency cash that resists casual use.

The glass outer wall may be transparent allowing inspection of the paper currency.

It is thus a feature of at least one embodiment of the invention to allow consumer or transferee to confirm the presence of the currency before extraction or use.

The paper currency may be arranged within the glass tube to allow a printed denomination on the paper currency to be viewed through the outer wall.

It is thus a feature of at least one embodiment of the invention to permit the value of the currency to be assessed prior to breaking the tube by a consumer or transferee.

The glass tube may be sized to allow at least two digits of denomination to be viewed.

It is thus a feature of at least one embodiment of the invention to provide sufficient exposure of denomination digits necessary to uniquely identify some denominations of bills in a compact container.

In some embodiments, the paper currency may be a US $50 bill.

It is thus a feature of at least one embodiment of the invention to provide value of cash of appropriate value for an emergency and capable of being identified by as few as two digits.

The glass tube may have an internal diameter of greater than 5 mm and less than 10 mm and a length of greater than 76 mm and less than 127 mm.

It is thus a feature of at least one embodiment of the invention to provide a container that is both large enough for currency and yet small enough to be conveniently carried without undue risk of breaking.

The glass tube may be a borosilicate glass.

It is thus a feature of at least one embodiment of the invention to provide a container that is highly resistant to temperature shock, water, acids, and the like providing a long-term reliable storage of cash.

The opposite ends of the tube may be sealed by glass.

It is thus a feature of at least one embodiment of the invention to provide a robust container that may be constructed from a single glass tube to provide an assembly that is resistant to delamination, depolymerization, and the like, that might occur with other fabrication techniques.

The opposite ends of the tubes may present outwardly convex surfaces having a radius of greater than 3 mm.

It is thus a feature of at least one embodiment of the invention to provide a container with a smooth outer surface that resists catching or snagging on other materials such as may damage the container or those other materials.

In some embodiments the container may include a pouch sized to receive the tube and include a clip for attachment of the pouch to a personal article.

It is thus a feature of at least one embodiment of the invention to improve the accessibility and convenience of holding the personal cash on person.

The pouch further may further include a file adapted to cut a nick in the tube outer wall to break the tube.

It is thus a feature of at least one embodiment of the invention to provide a method opening the tube with lower risk of shattering or the creation of dangerous fragments.

These particular objects and advantages may apply to only some embodiments falling within the claims and thus do not define the scope of the invention.

DETAILED DESCRIPTION OF THE PREFERRED EMBODIMENT

Figure 1:
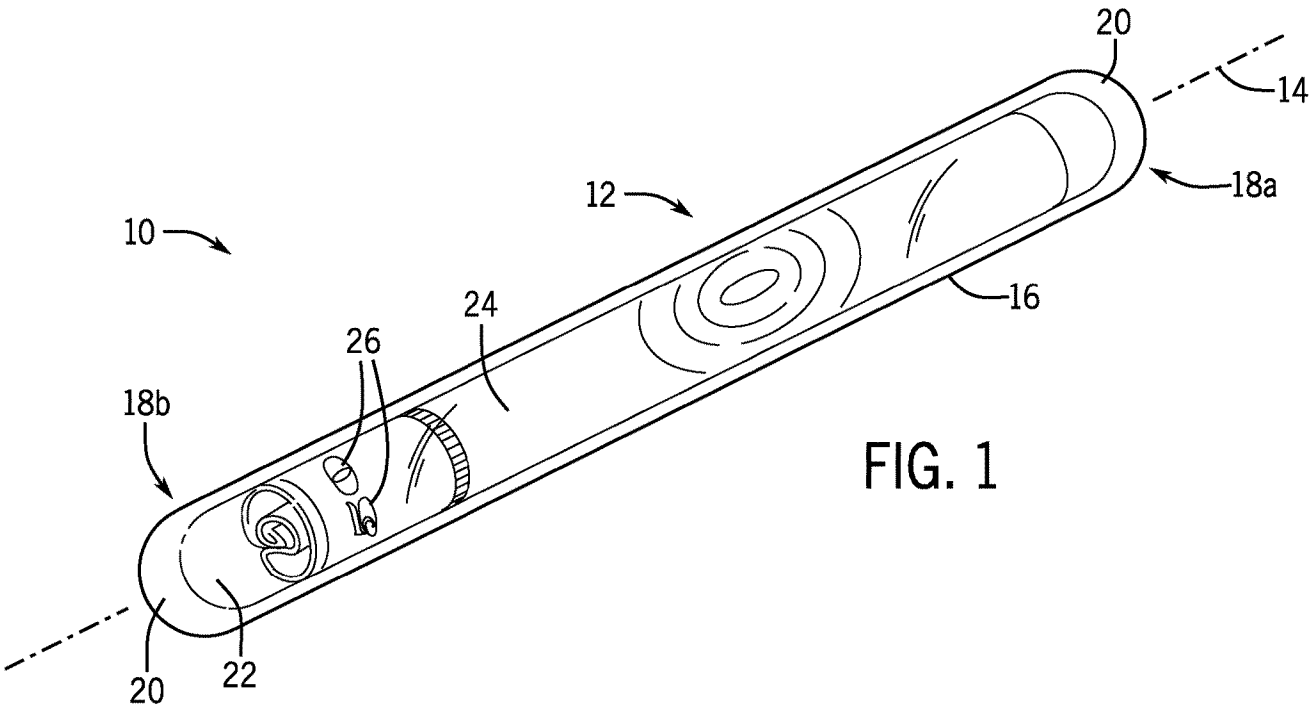
FIG. 1 is a perspective view of one embodiment of the invention providing a $50 bill in US currency sealed inside a glass tube.

Referring now to FIG. 1, an emergency cash container 10 constructed according to one embodiment of the present invention may provide for a transparent glass tube 12 extending generally along an axis 14 and presenting a cylindrical and transparent outer wall 16. Opposite ends 18*a* end 18*b* of the tube 12 are closed with glass plugs 20 to define a sealed internal volume 22 resistant to water and gas ingress and egress.

Positioned within the volume 22 is folded paper currency 24, in this case, a US $50 bill positioned so that at least two consecutive digits 26 of the currency 24 are visible through the outer wall 16. It will be appreciated that, at least for US currency, two consecutive digits 26 uniquely identify a $50 bill and thus allow a possessor of the cash container 10 to verify the contained denomination.

Figure 2:
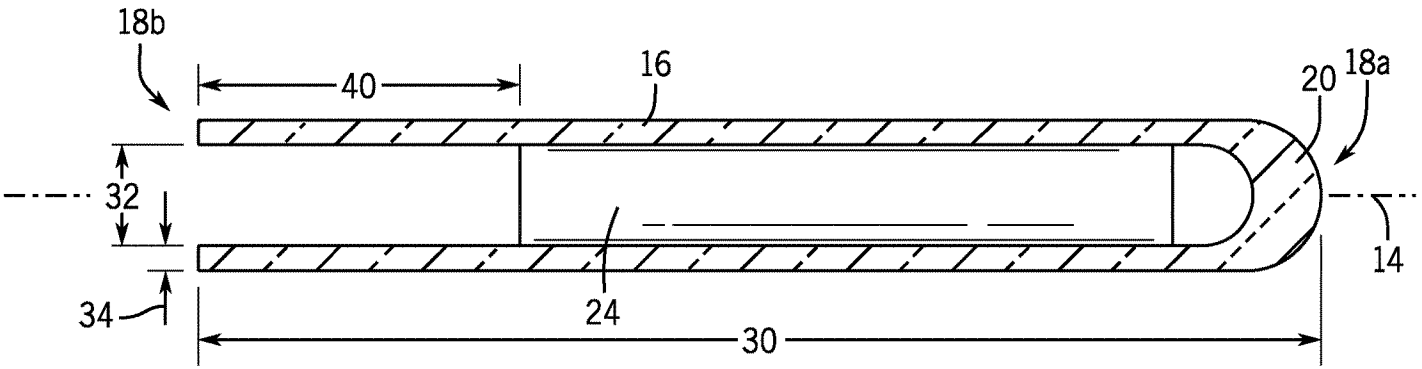
FIG. 2 is an elevational cross-section of the tube of FIG. 1 showing insertion of the currency prior to sealing of the second end of the tube and depicting particular tube dimension.

Referring now also to FIG. 2, in one embodiment, the entire container 10 is formed from a borosilicate cylindrical glass tube readily available on a commercial basis under the trade name Pyrex® and having a axial length 30 of 3 inches to 5 inches (approximately 76 mm to 127 mm) and, in some cases, having a length from 3½ inches to 4½ inches (approximately 89 mm to 115 mm) and preferably 4 inches in length (approximately 102 mm), and an internal diameter 32 between 6 mm and 10 mm and preferably 7 mm, and a wall thickness 34 of approximately 1 mm. The inventor has determined that this allows the receipt of a standard bill, for example, of US currency, comprising more than 20% linen and including colored synthetic fibers, and having a width of approximately 156 mm and a height of approximately 66 millimeters when tightly folded or rolled while allowing confirmation of the denomination digits 26.

For manufacture, a tube 12 of the appropriate length is cut and the end 18*a* is sealed by heating it with a propane-oxygen torch at a temperature of approximately 2800° C. near the inner blue flame cone with rotation at approximately one revolution per second. This heating allows the glass within a few millimeters of the end 18*a* to soften and flow together to create a glass plug. The resulting glass plug 20 has an outer convex surface along axis 14 with a radius of curvature approximating or greater than the radius of the tube 12 and greater than 3 mm and free from sharp edges.

The end 18*b* may be lightly flame polished to remove sharp edges that might catch on the currency 24 when the currency 24 is inserted. After cooling, the folded currency 24 is inserted into the tube 12 and moved as close as practical to the end 18*a*. The process described with respect to sealing the end 18*a* is then repeated for end 18*b*. During this second sealing process, the currency 24 is displaced from the end 18*b* by a spacer distance 40 at least three quarters of an inch determined to prevent singeing of the currency 24 during this process and consistent with the disclosed dimensions. In addition, the open end of the tube 12 may be tipped away from the axis of the flame during the sealing process so that the flame gases are directed at about a 30° angle to the axis 14 away from a direction entering the tube 12. This process of sealing either or both of ends 18*a* and 18*b* is facilitated by viewing the ends 18*a* and 18*b* through the outer wall 16 at an angle of about 30°.

Figure 3:
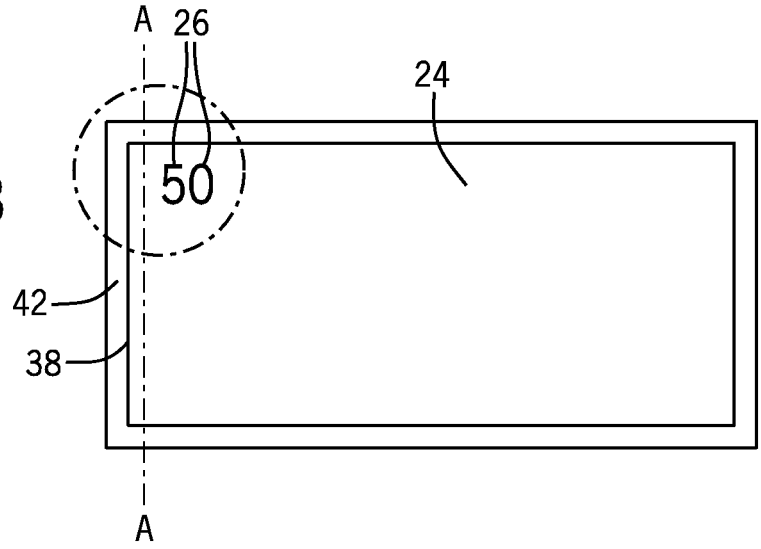
FIG. 3 is a simplified representation of an obverse side of the bill showing a printed denomination as will be exposed through the wall of the tube.

Referring now to FIG. 3, prior to insertion into the tube 12, the currency 24 is folded such as to preserve visibility of the digits 26 by first bending back a left margin 42 of the left edge of the reverse side of the currency 24 over the obverse side of the currency 24 along lines A-A at a crease line 38 adjacent to but outside the digits 26.

Figure 4:
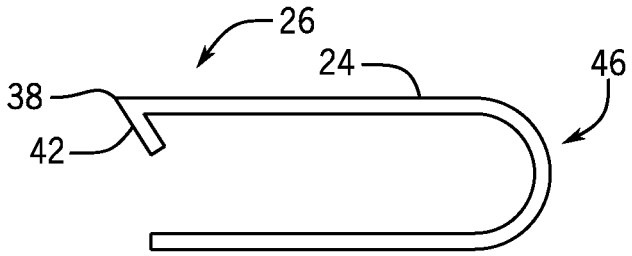
FIG. 4 is an elevational view of the bill of FIG. 3 after a first two folding operations prior to insertion of the bill in the tube such as preserves exposure of the denomination on an outward edge.

Referring now to FIG. 4, the right edge of the bill is then folded over the obverse face of the bill to align with the crease line 38. This fold is then creased (not shown in the figures for clarity) at a crease location 46.

Figure 5:
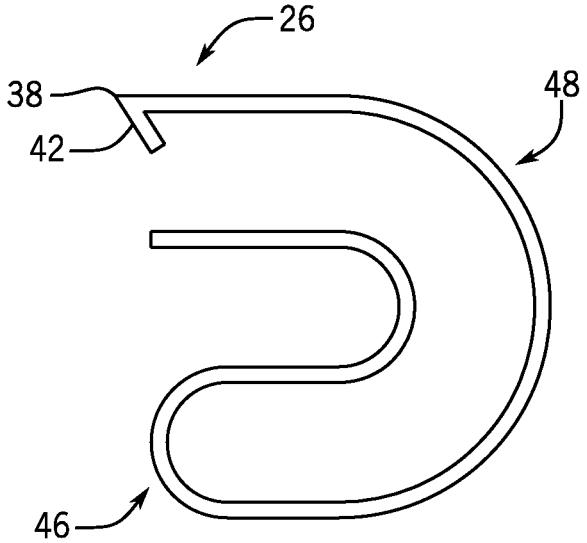
FIG. 5 is a figure similar to FIG. 4 showing a subsequent folding pattern which will be continued until the proper dimension of the currency is obtained for insertion into the tube.

As shown in FIG. 5, this process may be repeated with the crease location 46 folded again so as to align with the crease line 38 presenting a new crease location 48 which may also be creased. This process is then repeated three more times until the bill may fit snugly within the tube 12 as shown in FIG. 2.

In an alternative embodiment, the currency 24 may be rolled about itself in a spiral whose cylindrical outer form may then fit within the tube 12. The rolling may be facilitated by a slotted mandrel, formed, for example, by a stiff wire folded back along itself to provide a slot between the folded wires. A short length of one end of the currency 24 may be inserted into the slot and then the mandrel rotated while maintaining slight tension on the currency to tightly wind the currency about the mandrel. The mandrel may then be removed and the currency, as so rolled in a helical spiral, may be inserted into the tube 12. Proper orientation of the currency 24 and rotational direction of the mandrel exposes the digits 26 as discussed above.

Figure 6:
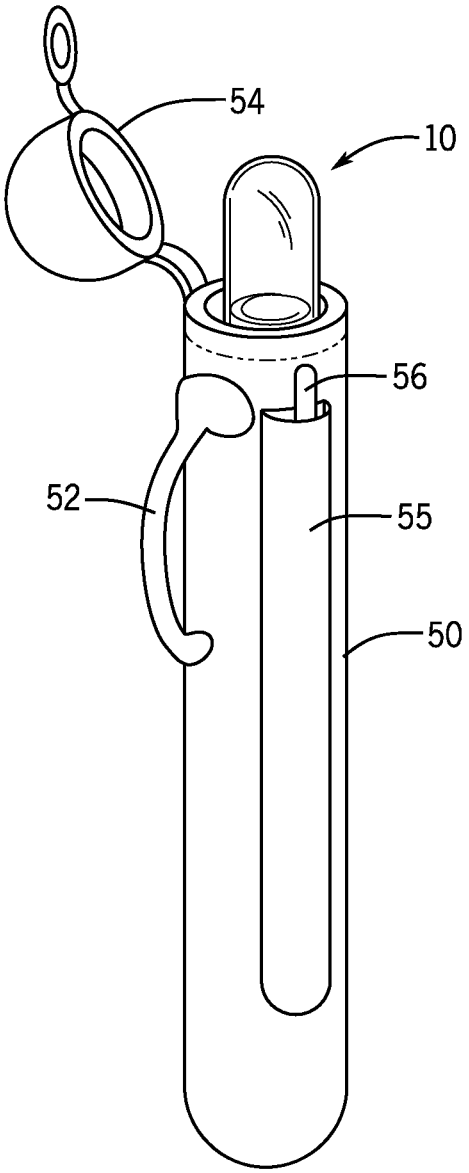
FIG. 6 is a perspective view of a holder for the tube of FIG. 1 that can carry the tube and also carry a file for simplified opening of the tube.

Referring now to FIG. 6, in one embodiment, the container 10 may fit within a holder 50, for example, constructed of leather, cloth, or molded polymer material that includes a clip 52 or other attachment such as a split ring, hook, or the like to allow the container 10 to be readily attached to an article of clothing, a key ring, or the like while providing additional protection against breakage of the glass material. The holder 50 may have a cap 54 releasably closeable over an open end of the holder 50 to retain the container 10 therein. The holder 50 may further include a pocket or similar attachment 55 for holding a small file 56, for example, a triangular rat tail steel or diamond file, that may be used to nick the tube 12 allowing the tube 12 to be readily broken with minimal shattering by applying a bending force to the tube 12 on either side of the neck such as tends to expand the material about the nick. In an alternative embodiment, the clip 52 may incorporate a file edge that similarly may be used to nick the tube 12 to facilitate its opening.

It is appreciated that the contained currency 24 may in fact be used without removal from the glass container because of the ready verifiable denomination and in certain circumstances this may be used to provide increased purchasing power because of the value of the currency as contained within a sealed container. Nevertheless it is believed that use of the container in this regard, that is without breaking the container, is sufficiently cumbersome as to prevent nonemergency usage. More generally, the container provides for long-term storage of currency in a variety of applications where environmental contamination might be a concern, for example, in moist or corrosive environments.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

The term breaking is intended to indicate practical irreversible separation of material including shattering cutting sawing drilling and the like.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

To aid the Patent Office and any readers of any patent issued on this application in interpreting the claims appended hereto, applicants wish to note that they do not intend any of the appended claims or claim elements to invoke 35 U.S.C. 112 (f) unless the words "means for" or "step for" are explicitly used in the particular claim.

I claim:

1. An emergency cash container comprising:

a glass tube providing a glass outer wall and closed at opposite ends to provide a sealed volume; and paper currency having a value of greater than US $20 in 2023 positioned within the sealed volume;

wherein the paper currency can be removed from the sealed volume only by breaking the tube; and wherein the opposite ends of the tube are sealed closed by glass.

2. The emergency cash container of claim 1 wherein the glass outer wall is transparent allowing inspection of the paper currency.

3. The emergency cash container of claim 2 wherein the paper currency is arranged within the glass tube allowing a printed denomination on the paper currency to be viewed through the outer wall.

4. The emergency cash container of claim 3 wherein the glass tube is sized to allow at least two digits of the printed denomination to be viewed.

5. The emergency cash container of claim 4 wherein the paper currency is a US $50 bill.

6. The emergency cash container of claim 1 wherein the glass tube has an internal diameter of greater than 5 mm and less than 10 mm and a length of greater than 76 mm and less than 127 mm.

7. The emergency cash container of claim 1 wherein the glass tube is a borosilicate glass.

8. The emergency cash container of claim 1 wherein the opposite ends of the tube present outwardly convex surfaces having a radius of greater than 3 mm.

9. The emergency cash container of claim 1 wherein the tube is watertight and airtight.

10. The emergency cash container of claim 1 further including a pouch sized to receive the tube and including a clip for attachment of the pouch to a personal article.

11. The emergency cash container of claim 10 wherein pouch further includes a file adapted to cut a nick in the glass outer wall to break the tube.

12. The emergency cash container of claim 1 wherein the paper currency is at least 20% linen and includes colored synthetic fibers.

13. The emergency cash container of claim 1 wherein the paper currency has a height of less than 70 mm and a width of less than 160 mm.

14. A method of fabricating an emergency cash container comprising:

cutting a glass tube having an internal diameter of greater than 5 mm and less than 10 mm to a length of greater than 76 mm and less than 127 mm;

sealing a first end of the glass tube closed by heating the first end while rotating the tube to provide an outwardly convex plug having a radius of greater than 3 mm;

folding and inserting paper currency to fit within the glass tube to expose at least two digits of a denomination of the paper currency; and sealing a second end of the glass tube closed by heating the second end while rotating the tube to provide an outwardly convex plug having a radius of greater than 3 mm.

* * * * *